US005511373A

United States Patent [19]

Banba

[11] Patent Number: 5,511,373

[45] Date of Patent: Apr. 30, 1996

[54] METHOD AND APPARATUS FOR PIECING A SLIVER AND AT LEAST ONE OF A LEADING YARN AND A BOBBIN YARN

[75] Inventor: Susumu Banba, Kyoto, Japan

[73] Assignee: Murata Kikai Kabushiki Kaisha, Kyoto, Japan

[21] Appl. No.: 377,307

[22] Filed: Jan. 24, 1995

[30] Foreign Application Priority Data

Jan. 25, 1994 [JP] Japan ..... 6-023754

[51] Int. Cl.[6] ..... D01H 5/28; D01H 7/92

[52] U.S. Cl. ..... 57/328; 57/261; 57/279; 57/280; 57/333; 57/350

[58] Field of Search ..... 57/328, 350, 261, 57/279, 280, 333

[56] References Cited

U.S. PATENT DOCUMENTS

| | | | |
|---|---|---|---|
| 4,114,358 | 9/1978 | Tsuchida et al. | 57/328 |
| 4,545,193 | 10/1985 | Tanaka et al. | 57/328 |
| 4,819,419 | 4/1989 | Stahlecker et al. | 57/328 |
| 4,827,710 | 5/1989 | Nishimura | 57/328 |
| 4,845,932 | 7/1989 | Sakai et al. | 57/328 |
| 4,845,936 | 7/1989 | Artzt et al. | 57/328 |
| 4,958,487 | 9/1990 | Suganuma et al. | 57/328 |
| 5,146,740 | 9/1992 | Mori | 57/328 |
| 5,159,806 | 11/1992 | Mori et al. | 57/328 |
| 5,211,001 | 5/1993 | Mori | 57/328 |
| 5,263,310 | 11/1993 | Mori | 57/328 |

FOREIGN PATENT DOCUMENTS 161525 11/1991 Japan .

*Primary Examiner*—William Stryjewski
*Attorney, Agent, or Firm*—Loeb and Loeb

[57] ABSTRACT

A method and apparatus for piecing a sliver and at least one of a leading yarn and a bobbin yarn. A nozzle member and a spindle member having a hollow spindle are provided. A relative spacing is established between the nozzle member and the spindle member. At least one of a leading yarn and a bobbin yarn is inserted into the hollow spindle of the spindle member relatively spaced from the nozzle member. The relative spacing between the spindle member and the nozzle member is decreased, so that the spindle member and the nozzle member mutually form an air chamber. A compressed air flow is directed into the air chamber. Sliver is supplied to at least one of the leading yarn and the bobbin yarn, and the sliver and at least one of the leading yarn and the bobbin yarn are pieced together.

5 Claims, 4 Drawing Sheets

L
T
Rb
Rt
D
Rs
Rf
n
5
9'
N
10
Sp
s
S
8
9
r
r
h
Cs
Y

L
Rf
7
5
3
n
2
6
3
f1
1
4
Y
s

METHOD AND APPARATUS FOR PIECING A SLIVER AND AT LEAST ONE OF A LEADING YARN AND A BOBBIN YARN

BACKGROUND OF THE INVENTION

1. Field of the Invention

The present invention relates, in a spinning machine for producing spun yarns utilizing a turning air flow, to a yarn piecing method for piecing cut or broken spun yarns.

2. Prior Art

In the conventional spinning machines for producing spun yarns utilizing a turning air flow, a yarn piecing method has been known in which when a spun yarn is cut or broken, yarn-piecing is carried out by drawing out a spinning yarn on the spinning side and a bobbin yarn on the take-up side, and introducing the spinning yarn and the bobbin yarn into a knotter.

In the spinning machines for producing spun yarns utilizing a turning air flow, a practical yarn piecing method has been known in which in the case where a spun yarn is cut due to a defect of the spun yarn itself or a defect of the apparatus, or in the case where a slub catcher disposed in the spinning machine detects a slub during spinning to forcibly cut the spun yarn, a spinning yarn on the spinning side and a bobbin yarn on the winding side are drawn out to introduce the spinning yarn and the bobbin yarn into a knotter for piecing them together. On the other hand, in the case of a spinning machine utilizing a turning air flow, for example, a spinning machine disclosed in Japanese Patent Application Laid-Open No. 161525/1991, a spun yarn is not produced merely by supplying a sliver drafted from a draft part to a spindle portion when spinning starts, and it is necessary to insert a yarn called a leading yarn (a yarn drawn from the yarn package) into the spindle portion from an outlet of the spindle. That is, it is sometimes impossible to piece a yarn to be spun from the spinning portion with a yarn on the side of a winding package.

SUMMARY OF THE INVENTION

An object of the present invention is to provide a yarn piecing method used when such a leading yarn is utilized to re-start the spinning, and more particularly to a yarn piecing method capable of positively carrying out the yarn piecing and providing an excellent pieced up sections.

For achieving the aforesaid object, the present invention provides a yarn piecing method in a spinning machine utilizing a turning air flow, comprising: inserting a leading yarn or a bobbin yarn on the take-up side into a hollow spindle of a spindle member separated from a nozzle member, and thereafter, generating a compressed air flow in an air chamber formed by the nozzle member and the spindle member to be combined; and provides the yarn piecing method, wherein the compressed air flow is formed into a flow which moves toward a suction hole for sucking air under weak suction pressure from a compressed air supply hole; and further provides the yarn piecing method in which the supplying of the compressed air flow starts before or after the start of movement of the spindle member separated from the nozzle member for combination.

DETAILED DESCRIPTION OF PREFERRED EMBODIMENT

The yarn piecing method according to the present invention will be described hereinbelow with reference to the drawings, but the present invention is not limited at all to the illustrated preferred embodiment.

First, a spinning machine to which the yarn piecing method according to the present invention is applied will be described with reference to FIG. 1 which is a side view including a section of a part of the spinning machine and FIG. 2 which is an enlarged sectional view of a nozzle member and a spindle member of the spinning machine showing the spinning principle of producing spun yarns utilizing a turning air flow.

Figure 1:
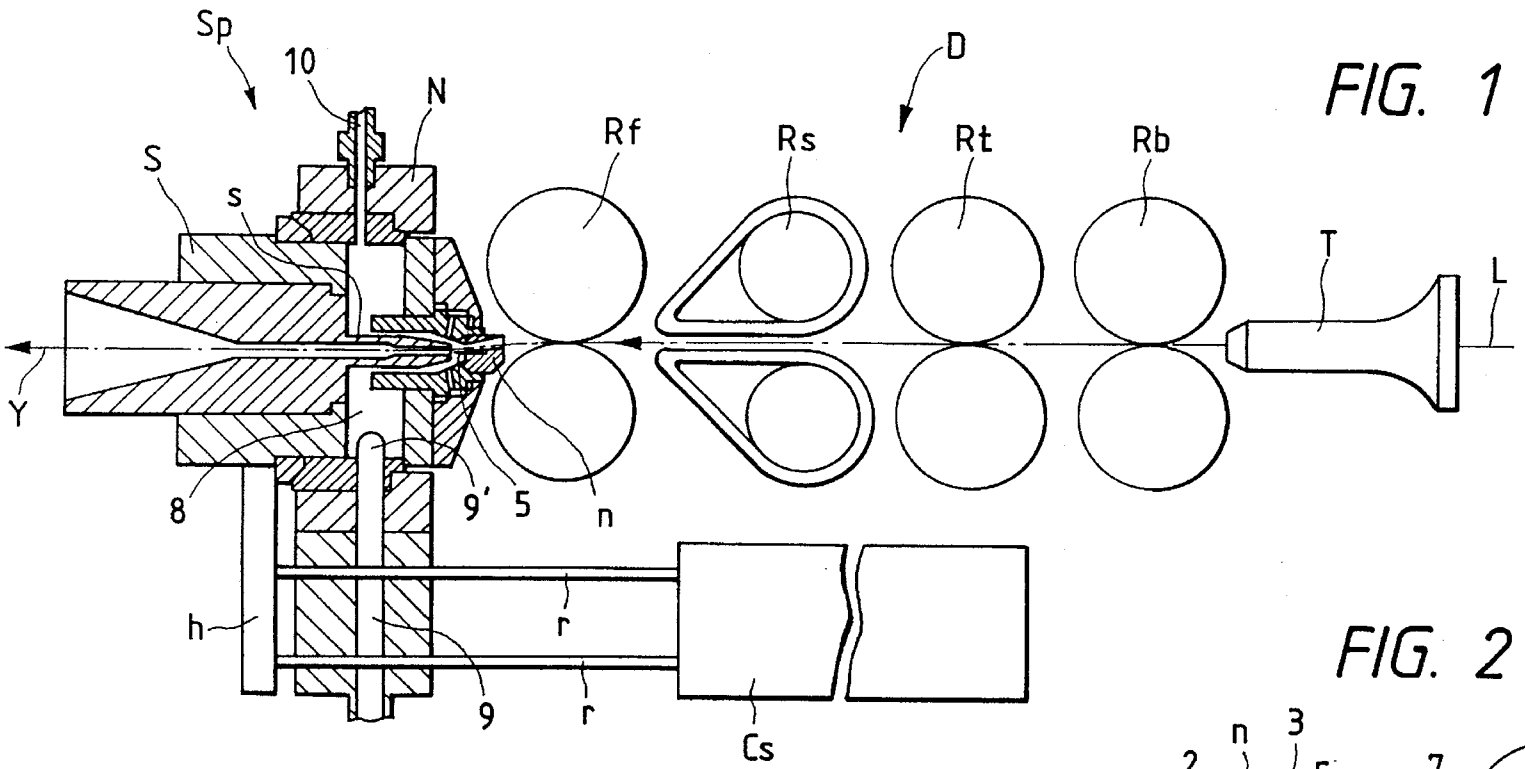
FIG. 1 may be a side view including a partial section of a spinning machine.

In FIG. 1, reference character L designates a sliver supplied to a draft device D via a sliver guide T. The draft device D comprises a back roller Rb, a third roller Rt, a second roller Rs having an apron and a front roller Rf. The sliver L drafted in the draft device D is supplied to a spinning section Sp comprising a nozzle member N and a spindle member S, and is formed into a spun yarn Y in the spinning section Sp.

The spindle member S is held on a support member h at the end of a rod r of a cylinder Cs, and can be separated from the nozzle member N or combined with the nozzle member N.

Figure 2:
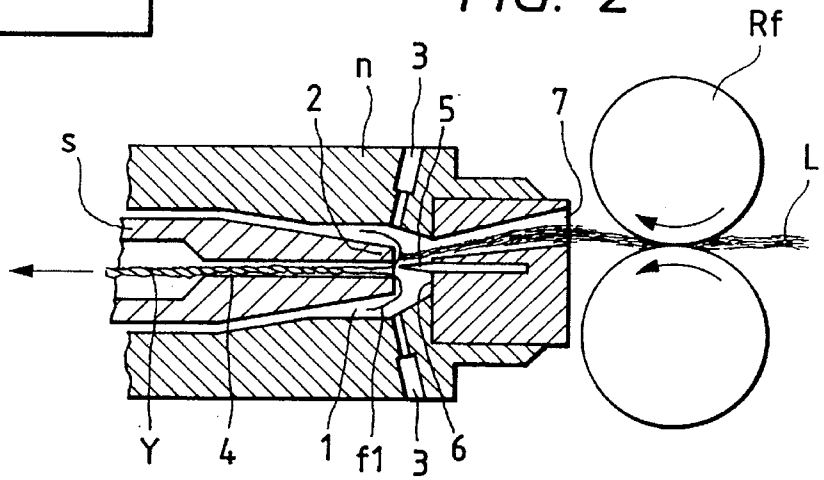
FIG. 2 is a partial enlarged sectional view of a nozzle member and a spindle member of the spinning machine showing the spinning principle of producing spun yarns.

FIG. 2 is a schematic partial enlarged sectional view of a nozzle n of the nozzle member N shown in FIG. 1 and a hollow spindle s of the spindle member S. The nozzle n is bored with a plurality of (for example, four) air jet orifices 3, which are inclined toward a conical end 2 of the hollow spindle s in a tangential direction of the peripheral wall of a cylindrical hollow chamber 1. Within the cylindrical hollow chamber 1, a needle-like guide member 5 having a diameter smaller than a diameter of an inlet portion of a hollow passage 4 of the hollow spindle s, of which free end is arranged so as to oppose to an inlet portion of the hollow passage 4 of the hollow spindle s, is mounted on an inner wall 6 on the side of the front roller Rf of the nozzle n.

While in the present embodiment, the hollow spindle s used is rotatably supported by an air turbine or suitable drive means such as a drive belt, it is to be noted that the hollow spindle s may be supported by a stationary means.

The drafted sliver L delivered from the front roller Rf of the draft device D is sucked into the cylindrical hollow chamber 1 within the nozzle n by a suction air flow in the vicinity of a sliver introducing hole 7 of the nozzle n which is generated by the action of jet air from the air jet orifices 3.

Fibers f1 constituting the sliver L sucked into the cylindrical hollow chamber 1 are fed along the periphery of the needle-like guide member 5, and in the vicinity of the conical end of the hollow spindle s, the fiber f1 is subjected to a turning air flow jetted out of the air jet orifices 3 and turning at high speeds in the outer periphery of the hollow spindle s and is twisted in a direction of the turning air flow while being separated from the sliver L.

At this time, the fiber f1 separated from the sliver L is that since the needle-like guide member 5 impedes the formation of core fibers and since the hollow spindle s is rotating so that it is evenly distributed in the outer periphery of the end portion of the hollow spindle s, the fibers to be a core are hardly present, and accordingly, most of the fibers are twisted to form a real-twisted spun yarn Y. Further, the twist applied by the turning air flow tends to propagate in the direction of the front roller R but this propagation is impeded by the needle-like guide member 5, and accordingly, the sliver L fed out of the front roller Rf is never twisted by such a twist as described. As described above, the fibers f1 applied with the twist are successively formed into spun yarns Y, which pass through the hollow passage 4 of the hollow spindle s and are fed in the direction of the spun yarn winding section. It is to be noted that the spun yarn forming device as described above is disclosed in, for example, Japanese Patent Laid-Open No. 161525/1991.

Next, the yarn piecing method when a yarn cut occurs, in the spinning machine for producing spun yarns utilizing the turning air flow as described above, will be explained with reference to FIG. 1 and FIGS. 3 to 5, which are side views including a partial section of the spinning machine similar to that shown in FIG. 1.

In FIG. 1, reference numeral 8 designates an air chamber formed between the nozzle member N and the spindle member S. The air chamber 8 is connected to an air suction source for sucking air under weak suction pressure through a suction hole 9, which acts as an escape hole for air jetted out of the air jet orifices 3 of the nozzle n during the spinning, and has a function to suck and remove floating fibers generated within the air chamber 8 during the spinning. The air chamber 8 is preferably always subjected to the action of weak suction air pressure during the spinning or yarn piecing.

Reference numeral 10 designates a compressed air supply hole whose one end is connected to a compressed air source not shown and the other end is connected to the air chamber 8. The compressed air supply hole 10 is arranged substantially opposite to the aforementioned suction hole 9. During the spinning, the compressed air from the compressed air source is not supplied to the air chamber 8 but is supplied at the time of yarn piecing later described.

Figure 3:
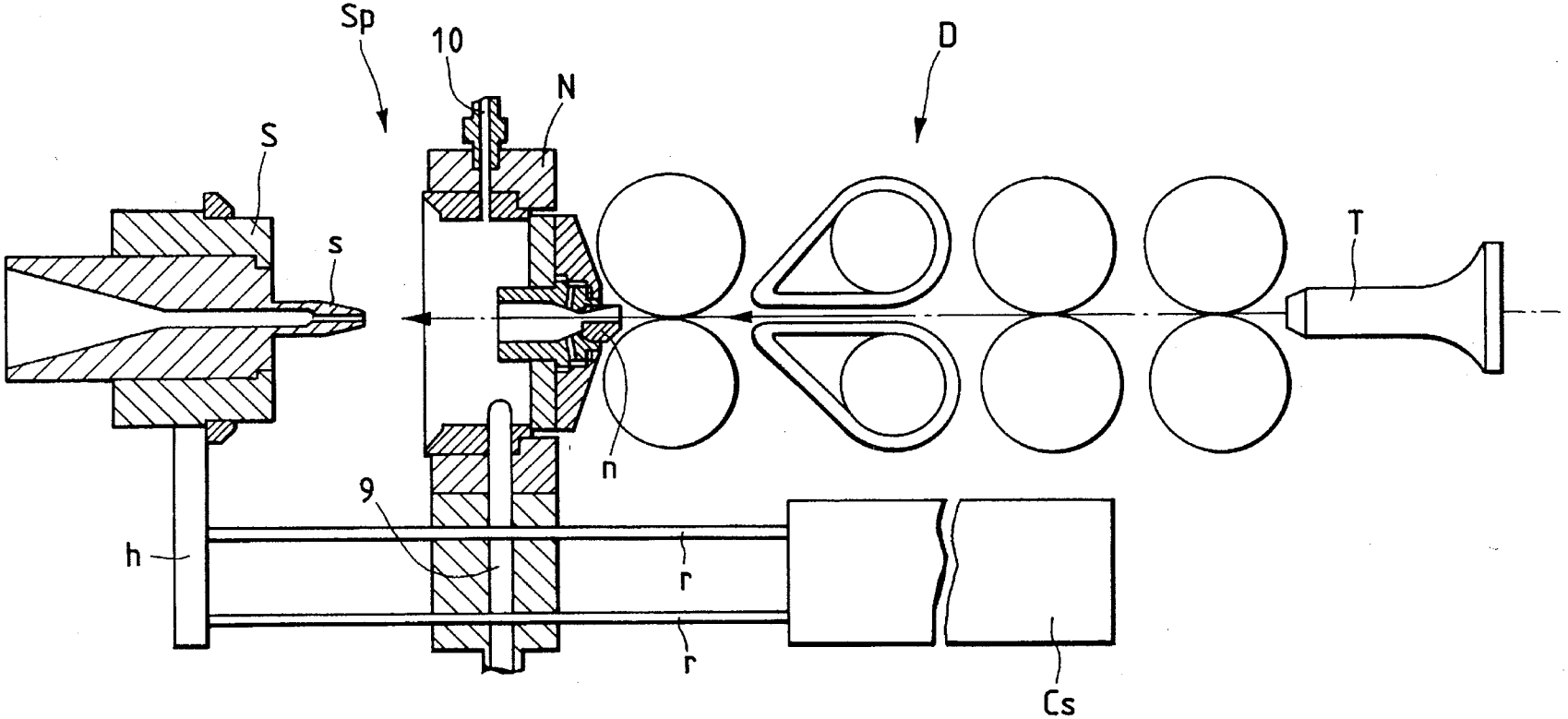
FIG. 3 is a side view including a partial section of the spinning machine similar to that shown in FIG. 1.

In the case where the spinning of spun yarns becomes impossible due to the causes such that the nozzle n of the spinning machine is stopped up with the sliver or impurities contained in the sliver, and as a result, the spun yarn is cut or broken, the driving of the draft device D is stopped to stop a supply of the sliver L to the spinning section Sp, after which as shown in FIG. 3, a cylinder Cs is actuated so that the spindle member S held on the support member h at the end of the rod r is separated from the nozzle member N. It is to be noted that drawing of the spun yarns and taking-up of the spun yarn on a package by means of a delivery roller not shown are stopped simultaneously with the stopping of the driving of the draft device D.

Figure 4:
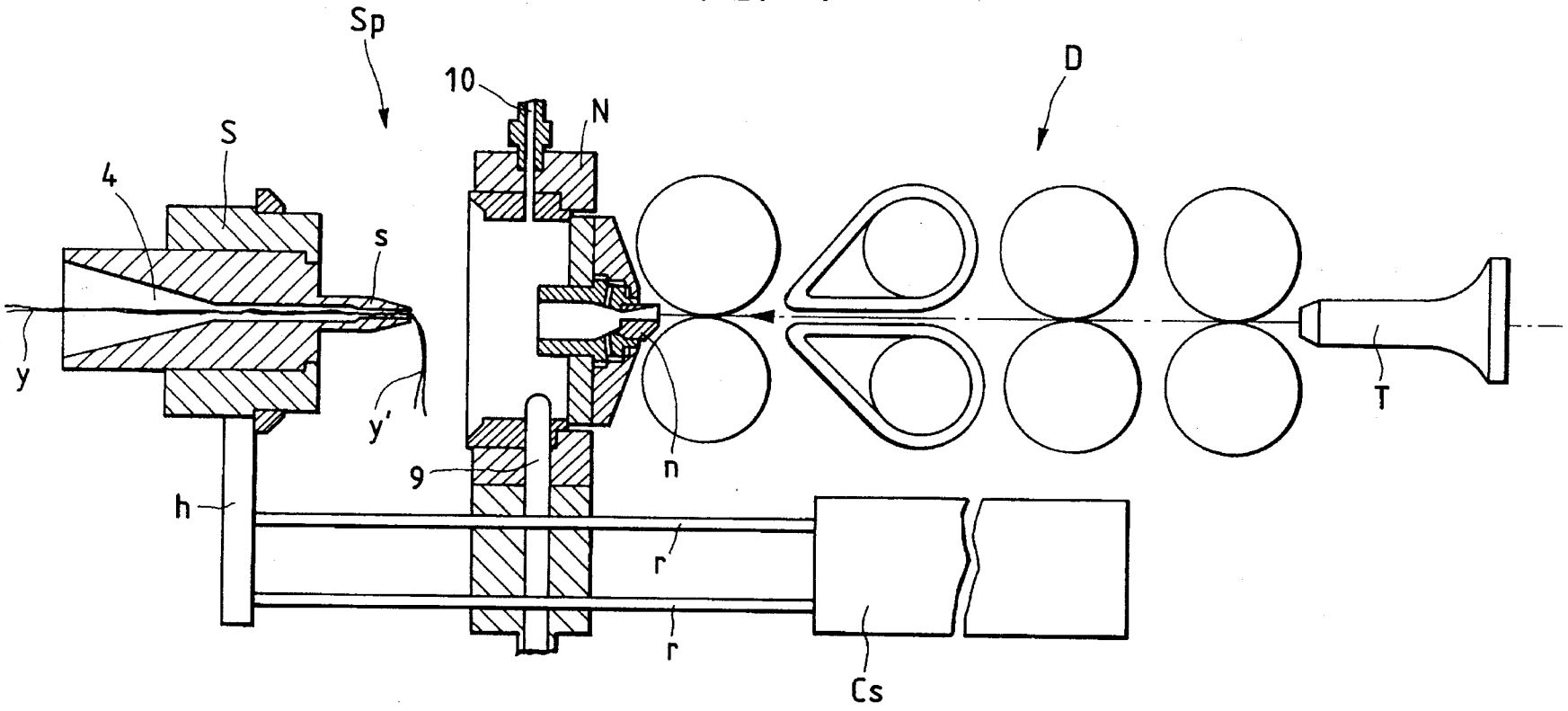
FIG. 4 is likewise a side view including a partial section of the spinning machine similar to that shown in FIG. 1.

Next, as shown in FIG. 4, a bobbin yarn or a leading yarn (a yarn drawn from the yarn package, and hereinafter merely referred to as leading yarn y on the winding side is allowed to pass through the hollow passage 4 of the hollow spindle s and is drawn out to a suitable length, by suitable means such as suction means not shown, from the end of the hollow passage 4. At the same time, an end y' of the leading yarn y is untwisted by an opening device or the like utilizing an air flow. The length of the leading yarn y drawn out of the end of the hollow passage 4 is preferably the length such that when the spindle member S and the nozzle member N are combined, the end of the opened leading yarn y reaches an inlet 9' of the suction hole 9 or somewhat moves into the inlet 9'.

Figure 5:
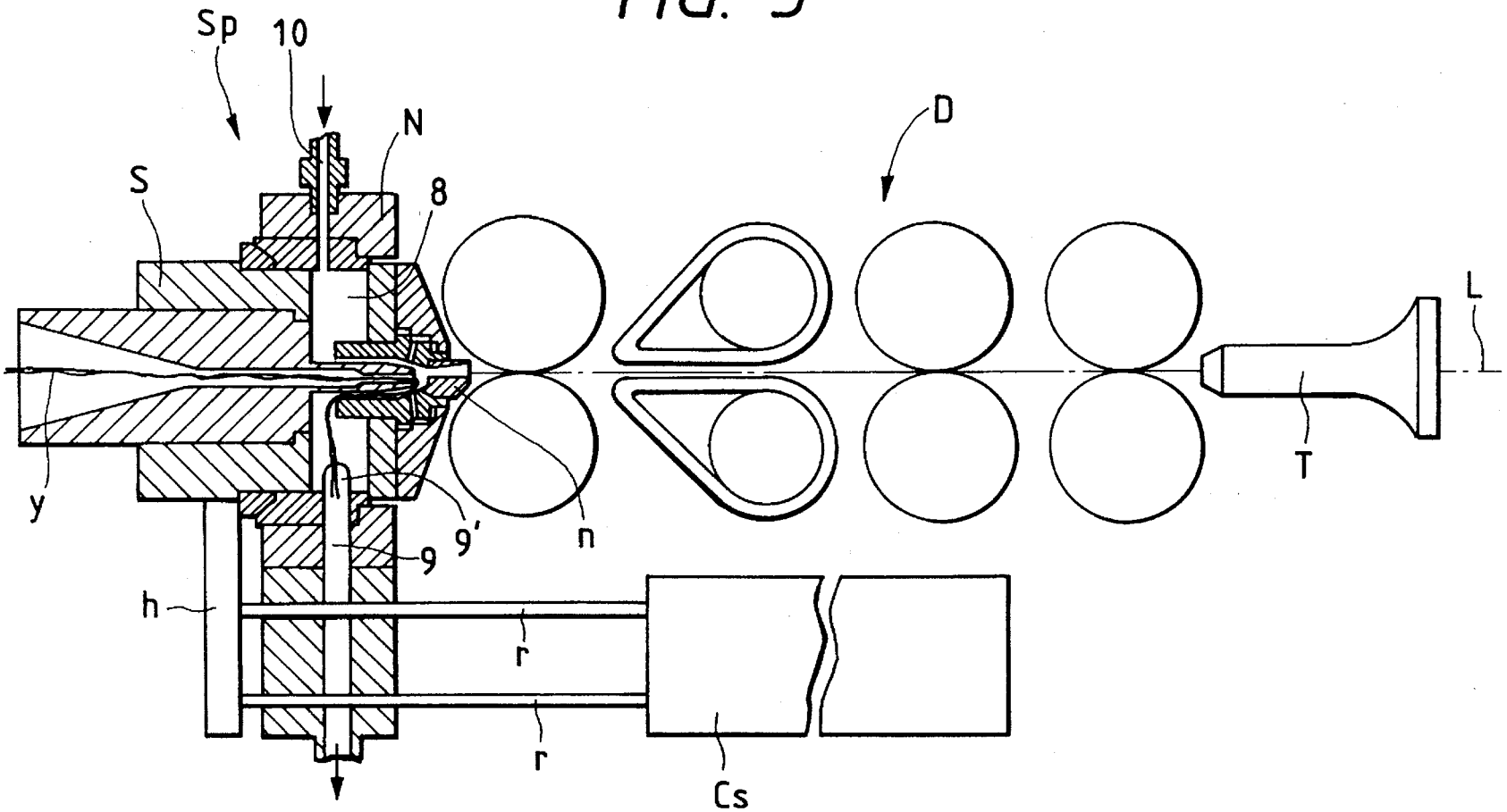
FIG. 5 is likewise a side view including a partial section of the spinning machine similar to that shown in FIG. 1.

Subsequently, the cylinder Cs is actuated to combine the spindle member S and the nozzle member N which have been separated, as shown in FIG. 5.

The actuation of the cylinder Cs causes compressed air to be supplied from the compressed air supply hole 10 to the air chamber 8 before or after the movement of the spindle member S being held on the support member h at the end of the rod r in the direction of the nozzle member N.

The compressed air can be supplied from the compressed air supply hole 10 to the air chamber 8 before or after movement of the spindle member s in the direction of the nozzle member N to thereby clean the spindle member S and the nozzle member N with the compressed air.

In the process that the spindle member S and the nozzle member N are combined, the leading yarn y drawn out of the end of the hollow passage 4 is moved in the direction of the inlet 9' of the suction hole 9 by the compressed air flow which flows in the direction of the inlet 9' of the suction hole 9 from the compressed air supply hole 10 and the twist contraction, snarls or kinds are removed so that the yarn y is to be stretched without being bended.

Upon the restart of the driving of the draft device D, the sliver L is supplied from the nozzle n to the leading yarn y in the condition as described above, and when the leading yarn y is started to be removed in the winding direction by a delivery roller not shown, the fiber f1 separated from the sliver L is successively arrested by the leading yarn y with the twist contraction, snarls or kinks removed and then stretched by the compressed air flow which flows in the direction of the inlet 9' of the suction hole 9 from the compressed air supply hole 10 whereby the spun yarn Y continuous to the leading yarn y is formed, thus completing the yarn piecing.

The supply of the compressed air from the compressed air supply hole 10 to the air chamber 8 is stopped after completion of the aforementioned yarn piecing, and the air chamber 8 returns to its weak negative pressure state.

As described above, since during the yarn piecing, the leading yarn y is applied with tension by the compressed air flow which flows in the direction of the inlet 9' of the suction hole 9 from the compressed air supply hole 10 and then stretched to maintain a stable state, the fiber f1 separated from the sliver L becomes positively wound about the leading yarn y. Accordingly, the success rate of the yarn piecing is enhanced, and it is possible to prevent the twist contraction, snarls or kinks from remaining in the yarn piecing portion of the spun yarn Y which has been already jointed and the spun yarn from being cut again by a slub catcher or the like.

Being the present invention configured as described above, the following effects are obtained.

Since the leading yarn is maintained in a stretched and stable state, the fibers separated from the sliver become positively wound about the leading yarn, thus enhancing the success rate of yarn piecing.

It is possible to prevent the twist contraction, snarls or kinks from remaining in the yarn piecing portion of the spun yarn Y which has been already pieced and the spun yarn from being cut again by a slub catcher or the like.

What is claimed is:

1. A yarn piecing method utilizing a turning air flow for piecing a sliver and at least one of a leading yarn and a bobbin yarn on a take-up side, comprising:

providing a nozzle member having a surface and a spindle member having a surface and a hollow spindle, establishing a relative spacing between the nozzle member and the spindle member, inserting at least one of a leading yarn and a bobbin yarn on a take-up side into the hollow spindle of the spindle member relatively spaced from the nozzle member, decreasing the relative spacing between the spindle member and the nozzle member so that at least a portion of the surface of the spindle member and at least a portion of the surface of the nozzle member mutually form an air chamber, generating a compressed air flow, directing the compressed air flow into the air chamber, and supplying sliver to at least one of the leading yarn and the bobbin yarn, whereby the sliver and at least one of the leading yarn and the bobbin yarn are pieced together.

2. The method of claim 1, wherein the step of directing the compressed air flow into the air chamber comprises the step of providing the air chamber with a compressed air supply hole through which compressed air is supplied to the air chamber, and further comprising:

providing the air chamber with a suction hole for sucking air from the compressed air supply hole, and directing the compressed air flow in the air chamber toward the suction hole.

3. The method of claim 1 or 2, wherein the step of generating a compressed air flow is initiated prior to the step of decreasing the relative spacing between the spindle member and the nozzle member.

4. A machine comprising:

a first member comprising a nozzle and having a surface, a second member comprising a hollow spindle having a top end and having a surface, at least one of the first and second members being separable from and moveable relative to the other of the first and second members, the first and second members defining a first configuration in which the first and second members are separated and a second configuration in which the first and second members are not separated, at least a portion of the surface of the first member and at least a portion of the surface of the second member in the second configuration mutually defining an air chamber in which the top end of the hollow spindle is positioned, the air chamber defining a compressed air supply hole through which compressed air is supplied to the air chamber and a suction hole for sucking air from the compressed air supply hole.

5. The machine of claim 4, wherein the first member comprises an inner wall and further comprising a guide needle mounted on the inner wall of the first member, the guide needle having a free end and being arranged so that the free end of the guide needle is in opposing relationship with the top end of the hollow spindle in the second configuration.

* * * * *